United States Patent [19]

Fish

[11] 4,379,364

[45] Apr. 12, 1983

[54] ARTIST'S FREEHAND SKETCHING DEVICE

[76] Inventor: Ivan L. Fish, 2804 Carolina NE., Albuquerque, N. Mex. 87110

[21] Appl. No.: 315,164

[22] Filed: Oct. 26, 1981

Related U.S. Application Data

[63] Continuation-in-part of Ser. No. 173,288, Jul. 29, 1980, abandoned.

[51] Int. Cl.[3] ..... B43L 13/16

[52] U.S. Cl. ..... 33/277; 454/10

[58] Field of Search ..... 434/90–92, 434/408–410, 85.88; 33/277, 276, 1 K, 20 C, 18 C; 248/441 A, 431, 167, 168, 163, 165, 150; 403/217

[56] References Cited

U.S. PATENT DOCUMENTS

| | | | |
|---|---|---|---|
| 9,409 | 11/1852 | Richter | 33/1 K |
| 254,178 | 2/1982 | Lith | 33/277 |
| 2,188,237 | 1/1940 | Weaver | 248/168 |
| 3,678,589 | 7/1972 | Baier | 33/277 |

FOREIGN PATENT DOCUMENTS

| | | | |
|---|---|---|---|
| 607532 | 3/1926 | France | 33/277 |
| 713298 | 8/1931 | France | 33/277 |
| 3289 | of 1883 | United Kingdom | 33/277 |

*Primary Examiner*—Harry N. Haroian
*Attorney, Agent, or Firm*—Walter R. Keller

[57] ABSTRACT

A device for use by artists and others to aid in freehand sketching, comprising generally a base, a transparent sketching surface in an upright position and a chin rest less than an arm's length away from the sketching surface, said base being supported by nesting folding legs, or being supported by the artists' knees, when the artist is in a sitting position, wherein the artist views the object to be sketched through the sketching surface and sketches directly on the sketching surface.

5 Claims, 3 Drawing Figures

ARTIST'S FREEHAND SKETCHING DEVICE

This is a continuation in part of application Ser. No. 173,288 filed on July 29, 1980, now abandoned.

SUMMARY

In general, the more difficult aspects of freehand sketching for an artist to accomplish, are perspective and proportions. Skill in translating what is seen into proper proportions and perspective, especially in freehand drawing, is learned only through long experience. It is an objective of this invention to provide a means for the novice artist to draw, sketch or otherwise accomplish properly proportioned freehand sketches in proper perspective, and indeed to provide even more accomplished artists a means for quickly and easily sketching an object or objects for later transfer to another medium.

BACKGROUND OF THE INVENTION

1. Field of the Invention

This invention relates generally to artists equipment, and more particularly to a visual aid for freehand sketching.

2. Description of Prior Art

Most commonly artists have in the past used an indirect gauge for generally accomplishing proper proportion and perspective in their sketches of an object. Several devices have been invented to aid the artist, and typical is the device illustrated in Baier, U.S. Pat. No. 3,678,589. Baier shows a tripod mount on a base for sketching on a transparent surface, but fundamentally requires a peep sight, lens or other device through which the artist views with only one eye. Puel, a French inventor, described in his patent, Document No. 713,298 a device utilizing a chin rest for the artist and permitted the artist to view with both eyes. Puel, however, assumes that his device is placed on a platform, such as a table, to stabalize the invention.

DESCRIPTION OF THE PREFERRED EMBODIMENT

Figure 1:
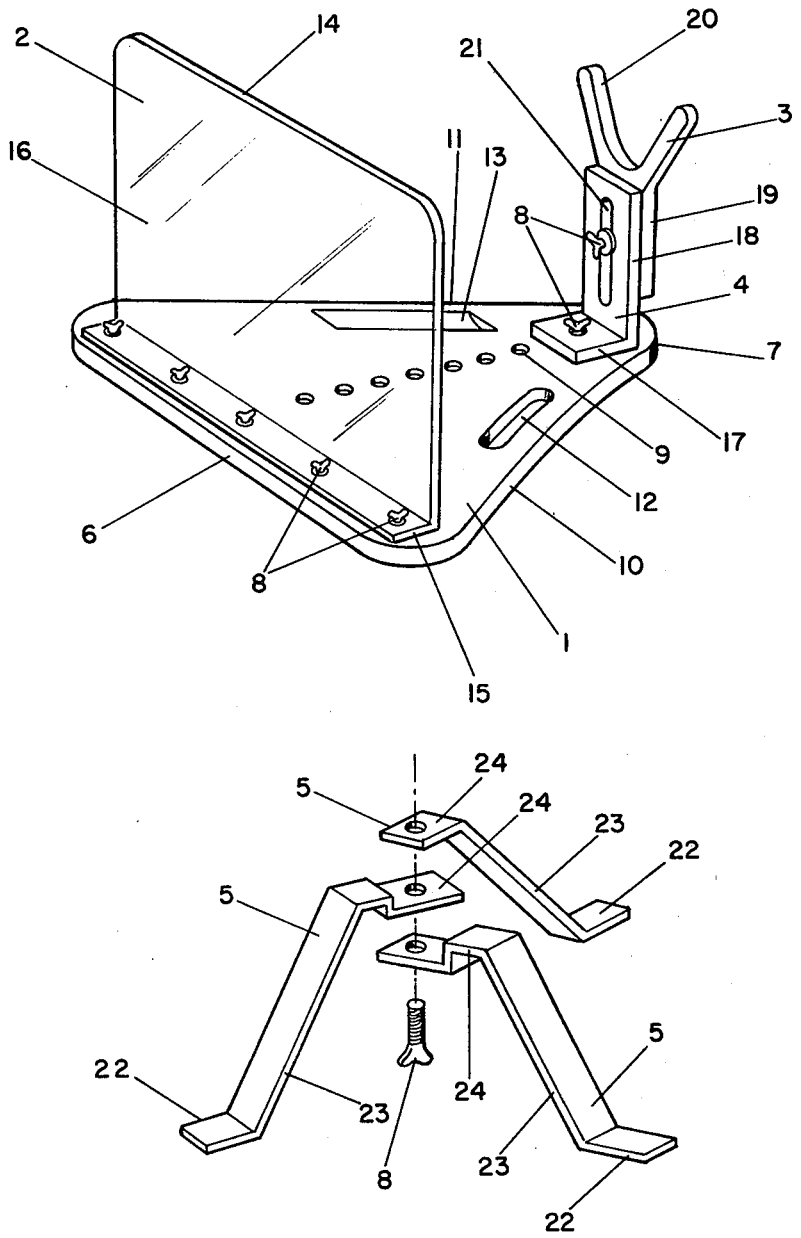
FIG. 1 is an isometric view of the invention.

As shown in FIG. 1 the invention comprises a base 1, a vertical member 2, a chin rest 3, a rest support 4, and legs 5. The base 1 is generally a flat triangular shaped member having a generally straight edge 6 and an apex 7. As shown, all corners are rounded for safety and comfort. The base 1 is made of rigid material such as but not limited to wood. Along the straight edge 6, the base 1 has a plurality of mounting holes which will accept bolts 8. Begining near the apex 7, and aligned toward the straight edge 6 the base 1 has a plurality of support holes which pass through the base 1, said support holes 9 also being sized to accept bolts 8. As viewed from the apex 7 toward the straight edge 6, the base 1 has a left side 10 and a right side 11. Adjacent to and along the left side 10, the base 1 has an opening sized to form a hand-hold 12. Adjacent to and along the right side 11, the base 1 has a pen-trough 13. The vertical member 2 is generally rectangular, flat, transparent sheet of material having a top edge 14, and a bottom edge being bent at approximately a right angle to form a foot 15. The foot 15 has a plurality of holes matching the mounting holes adjacent to and along the straight edge 6, so that the vertical member 2 is attached to the base 1 by means of the bolts 8. An alternative means of attaching the vertical member 2 to the base 1 is to have two channels, not shown, mounted perpendicular to the base 1 such that the vertical member 2 slides into the channels. The vertical member 2 has a sketching surface 16 toward the apex 7 which when assembled rises essentially perpendicular to the base 1. It is not necessary that the sketching surface 16 be perpendicular to the base 1; on the contrary, tilting the sketching surface 16 slightly away from the apex 7 for comfort may be desireable and is also contemplated by this invention. The vertical member 2 must be of transparent material; glass, or rigid plastics, or synthetic resins will function. Glass, even safety glass may be used, but breakage and its weight are undersireable properties of glass. Best results have been obtained with smooth surfaces, transparent, clear plastic or synthetic resins sold under the trademarks of PLEXIGLAS and ACRYLITE.

The chin rest 3 and rest support 4 are relatively rigid members, and may be made of wood, metal, or suitable rigid plastic or synthetic resin material. The rest support 4 is L shaped having a bottom foot 17 and a vertical leg 18. The bottom foot 17 has one or more bolt holes through which bolts 8 may pass, said bolts 8 also passing through support holes 9, thereby attaching the rest support 4 to the base 1 in a manner which allows the rest support 4 to be adjusted horizontally towards or away from the vertical member 2. The vertical leg 18 has an adjusting slot 21 running vertically from near the angle of the L in the rest support 4 to near the top of the vertical leg 18. The chin rest 3 is a Y shaped member having a stem 19 and chin yoke 20. The stem 19 has one or more bolt holes sized to accept bolts 8 which pass through the bolt holes in the stem 19 and through the adjusting slot 21 in the rest support 4, thus attaching the chin rest 3 to rest support 4 in a manner that permits vertical adjustment of the chin rest 3. It is obvious that if vertical adjustment of the chin rest 3 is not desired the chin rest 3 and rest support 4 may be made in one piece. The chin yoke 20 is two limbs at the top of the Y which are generally slightly rounded and flattened so an artist may comfortably position his chin and the lower part of his face therein. It has been found that the comfort of the chin rest 3 may be improved by padding. The chin rest 3 maybe made of flexible material such as aluminum, plastic or synthetic resin which may be shaped slightly to accomodate each individual user. It is also recognized that perspiration may cause corrosion of metal chin rests 3, thus an advantage for an annodized metal or a plastic type chin rest 3. Furthermore the general shape of the yoke 20 is required to be only such that the user may move his head from the sketching position to rest; yet be able to return to the yoke 20 and reposition the head in the same location. An example of another style chin rest 3 would be a curved chin pocket with a forehead lean bar attached thereto. Any of these means for supporting the head in the desired position are known and of standard construction, and contemplated as being a chin rest 3.

The legs 5 are shown to be a foldable, nesting type tripod, which is affixed to the base 1 on its under side by means of a support bolt 8 which passes through the legs 5 and through the base 1. As shown, each of the legs 5 has a horizontal floor foot 22, and oblique leg 23, and a generally horizontal attaching arm 24. Each horizontal attaching arm 24 has a bolt hole through which a support bolt 8 may pass, and attach the set of legs 5 to the base 1 by means of the single bolt 8 passing through all of the legs 5 and the support hole. The leg 5 which attaches nearest the bottom of the base 1 has a flat straight attaching arm 24. The next leg 5 which rests against the previous leg 5 when attached to the base 1, has a slight jog adjacent to its bolt hole to permit the majority of its horizontal arm 24 to rest against the base 1. The third leg 5 attached to the base 1 has an even greater jog adjacent to its bolt hole 1, accomodating the thickness of the first two legs 5, yet also permitting the majority of its horizontal arm 24 to bear on the base 1. By loosening the support bolt 8 the three legs 5 can be turned about the support bolt 8 to a nesting or gathered position, not shown. While only three legs 5 are shown, it is obvious that more than three legs may be similarly attached. In fact, any standard tripod of sufficient strength such as a camera tripod, may be used. In addition, folding individual legs such as used on furniture, and card tables, may be affixed to the base to provide the required height and stability.

The artist in using the invention, positions himself with his chin in the chin rest 3 in such a manner that he views the objects or object to be sketched through the vertical member 2. With a scribing device, he sketches the object or objects directly on the sketching surface 16 as seen by him. This permits immediate and proper perspective, proportions, and shading by even the least skilled artist. The scribing device may be of any suitable type. Grease pencils or water color pens will work. One prefered type for use on transparent plastic, acetate and synthetic resins, is a permanent marking pen manufactured by Letraset USA, Inc. 40 Eisenhower Drive, Paramus, N.J., under the tradename "Pantone" black fine line pens, and another by Sanford Corp., Bellwood, Ill. 60104 called "VIS-A-VIS" K-16, narrow tip which has water soluble ink. Because of the mistakes an artist may make, and because it is required economically to make the sketching surface 16 reuseable, a means for cleaning or erasing is required. It has been found that many fluids such as lighter fluid, cleaning fluid and even gasoline will work. However, the safest and best results for removing the markings of the "Pantone" pen have been obtained by wiping off pen markings with isoproply alcohol, commonly refered to as rubbing alcohol. The ink from the Pantone pen on plastic synthetic resins, and acetate film surfaces is easily removed by isopropyl alcohol leaving virtually no residue on the surface, while water will remove the ink pen marking of the "VIS-A-VIS" pen.

Figure 2:
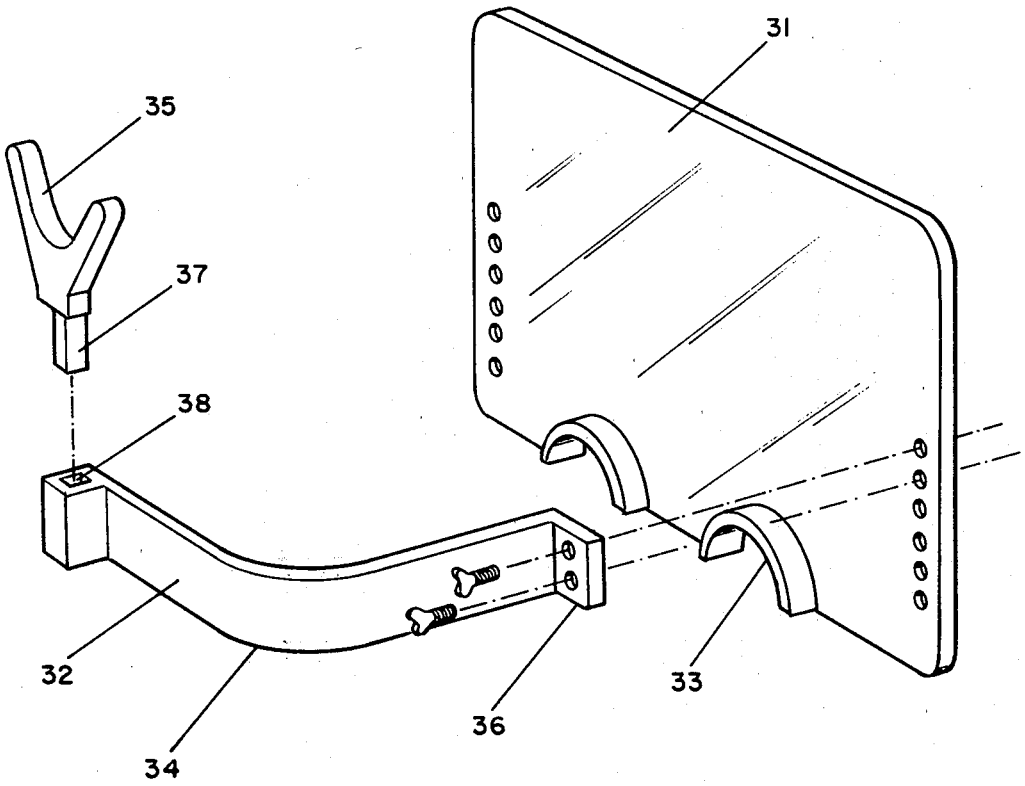
FIG. 2 is an isometric view of a portable version of the invention.

FIG. 2 shows a more portable version of the invention, to have a vertical member 31, and a head support 32. The vertical member 31 is made of the same materials and properties as was vertical member 2; however, in this portable version, vertical member 31 has two arcuate notches 33 along the bottom edge of the vertical member 31, said arcuate notches 33 being sized to comfortably rest on the thigh of the user just above the knee when the user is in a sitting position. The arcuate notches 33 may be padded, or have a widened surface for comfort. As shown in FIG. 2, the head support 32 comprises a curved arm 34 and chin rest 35. The curved arm 34 has a foot 36 with two or more bolt holes evenly spaced which match evenly spaced bolt holes along each side of the vertical member 31. The curved arm 34 can be attached to either side of the vertical member 31, by inverting the curved arm 34 from one side to the other, and yet the unattached end of the curved arm 34 will extend to a position near the center of the vertical member 31, and toward the user. Non-rotatably mounted to the unattached end of the curved arm 34 is the chin rest 35. The chin rest 35 being generally Y shaped having a stem 37 being generally rectangular. The unattached end of the curved arm 34 is bent to form a generally vertical rectangular hole 38. Thus, the stem 37 is slideably inserted in to the rectangular hole 38 and non-rotatably held therein. In use the user supports the vertical member 31 with his knees, and steadies the invention with his chin and freehand.

Figure 3:
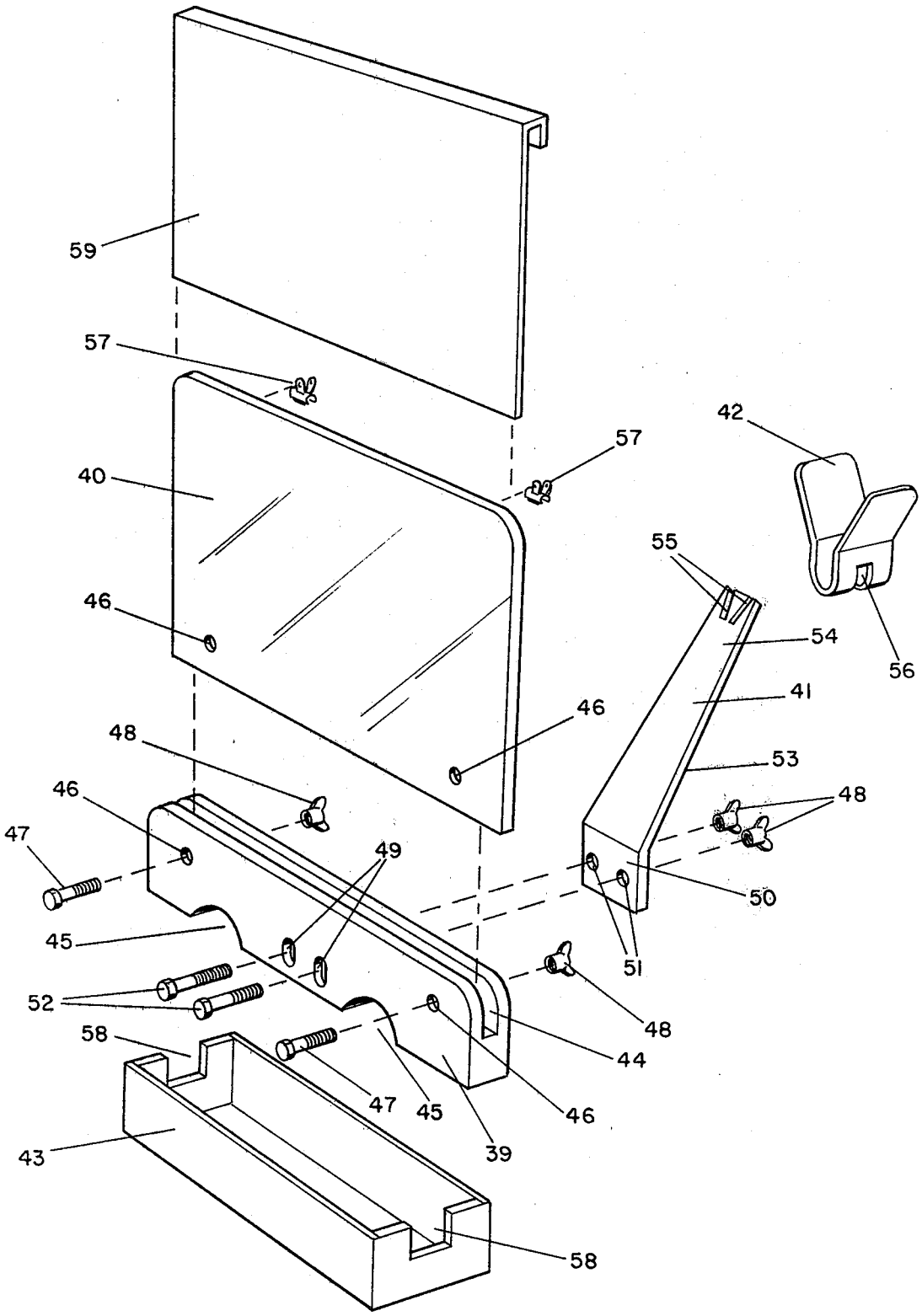
FIG. 3 is an isometric view of another configuration of a portable version of the invention.

FIG. 3 shows another portable version of the invention to have baseboard 39, a transparent vertical member 40, a chin rest post 41, a chin rest 42, and a utility support box 43. The baseboard 39, chin rest post 41, as well as the utility support box 43 may be made of any rigid material such as plastic, metal, or wood. The base board is generally rectangular and flat, having a groove 44, along its top edge, and two arcuate notches 45 on its bottom edge. The groove 44 is sufficiently wide and deep to slideably accept and support the vertical member 40. A plurality of matching bolt holes 46 are drilled through the baseboard 39 and the vertical member 40, so that bolts 47 may be inserted there through and secured by nuts 48 to removeably affix the vertical member 40 to the baseboard 39. The arcuate notches 45 are sized and positioned so that the baseboard 39 may be placed comfortably on the knees of the artist. The baseboard 39 has in its center, one or more vertical slots 49.

The chin rest post 41 has a foot region 50 at one end which has one or more bolt holes 51 spaced so that bolts 52 may pass through the bolt holes 51 and through the vertical slots 49, thus adjustably securing the chin rest post 41 to the baseboard 39. The chin rest post 41 has a stem region 53 which extends at a convenient angle from the foot region 50 so that the opposite end of the chin rest post 41, designated the slotted end 54, is, when assembled, displaced upward and away from the vertical member 40. The slotted end 54 has two chin rest slots 55. These chin rest slots 55 are angled toward each other, but not intersecting each other, as in a V without the vertex. The chin rest slots 55 are so angled to provide shape and support for the chin rest 42.

The chin rest 42 is made out of a flat rigid yet flexible and resilient plastic. A suitable material is manufactured by Rohm and Haas Company, Independence Mall West, Philadelphia, Penn., 19105 and marketed under the registered trademark Kydex. The material is available in a multitude of colors and thicknesses; and a thickness of approximately 0.125 inches has been found to be quite satisfactory. The material is fire resistant and easily cleaned and sanitized. The material comes in sheets, from which the proper size is cut or stamped, and a support slot 56 is cut in its middle. The material is then heated and pressure shaped and folded into generally a Y shape as shown. The chin rest 42 is then slid on to the slotted end 54.

The vertical member 40 is shown to have a plurality of spring clamps 57 on its top edge. Because artists may frequently make sketching trips and desire to make more than one sketch and preserve them, it is desired that the vertical member 40 be economically replaced or substituted for. It has been found that sheets of thin transparent acetate film or rigid plastic or synthetic resin or even almost transparent tracing paper can be clamped or otherwise attached to the vertical member 40, or the sketching surface 16 and 31 by any known means, such as spring clamps 57 or clothes pins or the like, and the artist can sketch on one surface, remove and replace with another, leaving the vertical member 40 or the sketching surface 16 and 31 to be used last, if desired.

Artists may become fatigued with sketching, and desire to take a rest pause. The utility support box 43, being a rigid rectangular box with two notches 58 in its ends provides a suitable place to place the baseboard 39, the utility support box 43 acting as a simple stand, yet also serving as a holder for pens, pencils, cleaners and other amenities.

Another convenient device which is optional with this invention is an opaque slip screen 59. The opaque slip screen 59 is shown to be made of rigid material with a lip formed at the top edge so that it slides securely and snugly on to the top of vertical member 40. The opaque slip screen 59 provides an opaque look to the transparent vertical member 40, and aids practice sketching. It also allows for sketching as a training aid such as might be used by football coaches in diagraming plays; or if white or silver could be used as a projector screen for slides, and movies. The opaque slip screen 59 may be of any rigid material such as metal or plastic. It is also obvious and contemplated within this invention that the opaque slip screen 59 could be of flexible material which is rolled and unrolled from the top or bottom of the vertical member 40 from a spring biased rotating drum, not shown, such as a movie projector screen, or an old style window blind.

I claim:

1. A device for use by artists and others to aid in freehand sketching, said device having a base, a transparent vertical member, a chin rest, and a means for supporting the base above a floor, table, or the ground, where-in said means for supporting the base above the floor, table, or the ground comprises a plurality of legs, each said leg having a horizontal floor foot, an oblique leg, and a horizontal attaching arm, each attaching arm having a bolt hole, and each attaching arm having a jog of sufficient depth to accommodate the thickness of the preceeding attaching arms, such that when all legs are mounted to the base by one support bolt the majority of each of the horizontal attaching arms bears against the base.

2. A device for use by artists and others to aid in free hand sketching comprising;

a vertical member having a generally flat rectangular shape and having two arcuate notches along its bottom, and a plurality of bolt holes evenly spaced along each vertical edge, and;

a head rest having a curved arm, one end of which has a foot with a plurality of bolt holes which match the bolt holes along the vertical sides of the vertical member, said curved arm being shaped so that when attached by bolts to a vertical edge of the vertical member the unattached end of the curved arm extends toward the center of the vertical member and toward the user, and the unattached end of the curved arm being shaped to form a generally rectangular vertical hole, and chin rest having a generally rectangular stem which slideably but non-rotatably inserts into the rectangular hole, said vertical member being made of transparent rigid material.

3. A device for use by artists and others to aid in free hand sketching comprising;

a baseboard being generally flat and rectangular having two arcuate notches along its bottom edge, and a groove along its top edge sized to accept a vertical member, and;

the vertical member, being transparent, and generally flat, and the vertical member being inserted into the groove, and the vertical member being secured to the baseboard by bolts and nuts, said bolts passing through matching bolt holes in the baseboard and the vertical member, and;

the baseboard having a plurality of vertical slots in its center, and;

a chin rest post having a foot region, a stem region and a slotted end wherein the foot region has a plurality of bolt holes matching the vertical slots in the baseboard so that the chin rest post may be adjustably affixed to the baseboard, and wherein the foot region is angled with respect to the stem region so that the stem region slopes upward and away from the vertical member, and wherein the slotted end has two slots which do not intersect each other but which angle toward each other forming generally a V without the vertex, and;

a removeable chin rest which slideably mates with the slotted end.

4. The device of claim 3 wherein the chin rest is made of flat rigid yet flexible and resilient plastic material and permanently folded to the general shape of a Y, and having a support slot at the bottom of the Y, to mateably fit the slotted end of the chin rest post.

5. The device of claim 3 wherein a temporary support is provided by a utility support box said utility support box having a slot in each end, said slots being sized to accept the baseboard.

* * * * *